US008522703B2

(12) United States Patent
Kawaguchi et al.

(10) Patent No.: US 8,522,703 B2
(45) **Date of Patent: *Sep. 3, 2013**

(54) MULTI-NEEDLE EMBROIDERY SEWING MACHINE

(75) Inventors: Yasuhiko Kawaguchi, Nagoya (JP); Masahiko Nagai, Nagoya (JP); Tomoyasu Niizeki, Inazawa (JP); Noboru Mizuno, Nagoya (JP); Masashi Tokura, Nagoya (JP); Shinichi Nishida, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 865 days.

This patent is subject to a terminal disclaimer.

(21) Appl. No.: 12/709,903

(22) Filed: Feb. 22, 2010

(65) Prior Publication Data

US 2010/0236460 A1 Sep. 23, 2010

(30) Foreign Application Priority Data

Mar. 23, 2009 (JP) ..... 2009-070253

(51) Int. Cl.
*D05B 19/00* (2006.01)

(52) U.S. Cl.
USPC ..... 112/470.05

(58) Field of Classification Search
USPC ..... 112/73, 78, 221, 222, 470.01, 470.05, 112/470.06, 475.18; 72/446, 455, 378, 379.2
See application file for complete search history.

(56) References Cited

U.S. PATENT DOCUMENTS

| | | | | |
|---|---|---|---|---|
| 4,527,498 | A * | 7/1985 | Tazawa | 112/323 |
| 5,810,526 | A * | 9/1998 | Hirai | 409/131 |
| 5,915,316 | A * | 6/1999 | Tajima et al. | 112/470.05 |
| 7,467,535 | B2 | 12/2008 | Kuno et al. | |
| 8,276,532 | B2 * | 10/2012 | Kawaguchi | 112/470.05 |

FOREIGN PATENT DOCUMENTS

| | | |
|---|---|---|
| JP | A-11-172566 | 6/1999 |
| JP | A-2007-8133 | 1/2007 |

* cited by examiner

*Primary Examiner* — Tejash Patel
(74) *Attorney, Agent, or Firm* — Oliff & Berridge, PLC

(57) ABSTRACT

A multi-needle sewing machine including a plurality of needle bars including a specific needle bar allowing detachable attachment of a punch needle that punch engraves a surface of a punch workpiece in dot-by-dot strokes; a transfer mechanism that allows detachable attachment of a punch workpiece holder a detector that detects the attachment of the punch workpiece holder on the transfer mechanism; and a controller that when the attachment of the punch workpiece holder is detected by the detector, executes a punch engraving operation on the punch workpiece with the punch needle by selecting the specific needle bar and by controlling a needle-bar selector/driver mechanism and the transfer mechanism based on punch engraving pattern data which is pre-stored or given by external components.

16 Claims, 11 Drawing Sheets

MULTI-NEEDLE EMBROIDERY SEWING MACHINE

CROSS-REFERENCE TO RELATED APPLICATIONS

This application is based upon and claims the benefit of priority from the prior Japanese Patent Application 2009-070253, filed on Mar. 23, 2009, the entire contents of which are incorporated herein by reference.

FIELD

The present disclosure relates to a multi-needle embroidery sewing machine provided with a needle-bar selector/driver mechanism that selects a needle bar from a selection of multiple needle bars, a transfer mechanism that allows detachable attachment of a workpiece holder and that transfers the workpiece holder in two predetermined directions.

BACKGROUND

Conventional multi-needle embroidery sewing machine is capable of consecutive executions of embroidery sewing operations with multiple thread colors. Such multi-needle embroidery sewing machine has a needle-bar case containing six needle bars, for instance, provided at the extremity of its arm. The required needle bar is selected from the needle bars contained in the needle-bar case by moving the needle-bar case in the left and right direction. The selected needle bar is thereafter connected to the needle-bar drive mechanism and driven up and down to execute the sewing operation.

The controller of the sewing machine receives input of pattern data that contains instructions on stitch-by-stitch needle drop point, which determines the movement amount of workpiece cloth, and timing for changing the thread color, etc. Based on the pattern data, the controller transfers the embroidery frame holding the workpiece cloth in the X and Y directions by the transfer mechanism while controlling the needle-bar drive mechanism and other drive mechanisms to form embroidery in multiple colors.

Recent developments in the above described multi-needle embroidery sewing machine is provision of a decoration feature for decorating a cloth using a method called needle punching. To elaborate, some of the needle bars mount a needle punch needle in place of an ordinary sewing needle for needle punching the workpiece cloth based on needle punch information.

A recent example of such feature is realized, for instance, by a puncher applying a dot impact printer that creates accessories and furnishings by punch engraving desired pictures, illustrations, and characters on objects such as plastic or metal plates and wooden or fiber-made boards with a punch needle. The puncher is configured to create a predetermined punch engraving on the surface of the workpiece by transferring the printer head provided with a plurality of punch needles in the X direction while transferring the workpiece in the Y direction.

Such feature of the puncher may be implemented on the above described multi-needle sewing machine by attaching a punch needle on some of the needle bars in place of a sewing needle. In such case, because the punch needle is designed to only impact the surface of the workpiece, it needs to be dimensioned in shorter length as compared to a sewing needle that penetrates the workpiece cloth. Further, a holder for holding the workpiece in place is attached to the carriage of the transfer mechanism instead of an embroidery frame for holding the workpiece cloth. The desired punch engraving can be formed on the surface of the workpiece by moving the workpiece based on punch engraving data and driving the needle bar mounted with the punch needle up and down.

However, mere replacement of sewing needle to punch needle on some of the needle bars of the multi-needle sewing machine is likely to introduce the following inappropriate occurrences. The user may accidentally start the embroidery sewing operation in which the needle bar having the sewing needle attached to it is driven up and down with the holder for punch needle attached to the carriage of the transfer mechanism. In such case, the sewing needle descends further downward as compared to the punch needle and thus, suffers a hard impact with the workpiece to damage itself or the workpiece especially since the workpiece held by the punch workpiece holder is made of relatively hard material.

In contrast, when the needle bar mounted with punch needle is accidentally moved up and down with the embroidery frame holding the workpiece attached to the carriage of the transfer mechanism, the punch needle may damage the workpiece cloth. Another possibility is that punch engraving operation such as the drive of the needle bar mounted with punch needle may be executed unwantedly based on the pattern data intended for embroidery sewing. In such case, needless or inappropriate operations such as thread wiping and thread cutting may be encountered during the punch engraving operation or the needle bar may be driven at excessive speed, for instance, that is unsuitable for punch engraving.

SUMMARY

One object of the present disclosure is to provide a multi-needle sewing machine that allows execution of a punch engraving operation on the surface of a punch workpiece in addition to execution of a normal embroidery sewing operation on a workpiece cloth while effectively preventing behaviors that are inappropriate for the ongoing type of operation.

In one aspect of the present disclosure a multi-needle sewing machine includes a plurality of needle bars allowing detachable attachment of a sewing needle, the plurality of needle bars including a specific needle bar allowing detachable attachment of a punch needle that punch engraves a surface of a punch workpiece in dot-by-dot strokes; a needle-bar selector/driver mechanism that selects one needle bar from the plurality of needle bars and that drives the selected needle bar; a holder that holds a workpiece and that is selected from the group of an embroidery frame that holds a workpiece cloth and a punch workpiece holder that holds the punch workpiece; a transfer mechanism that allows detachable attachment of either of the embroidery frame and the punch workpiece holder, and that drives the holder in two predetermined directions; a detector that detects the attachment of the punch workpiece holder on the transfer mechanism; and a controller that executes an embroidery sewing operation on the workpiece cloth with the sewing needle by controlling the needle-bar selector/driver mechanism and the transfer mechanism based on pattern data, and that, when the attachment of the punch workpiece holder is detected by the detector, executes a punch engraving operation on the punch workpiece with the punch needle by selecting the specific needle bar and by controlling the needle-bar selector/driver mechanism and the transfer mechanism based on punch engraving pattern data which is pre-stored or given by external components.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

A description will be given hereinafter on a first exemplary embodiment of the present disclosure with reference to FIGS. 1 to 8. In the description given hereinafter, the left and right direction relative to sewing machine body 1, also referred simply as sewing machine 1, is defined as the X direction whereas the front and rear direction relative to sewing machine 1 is defined as the Y direction.

Figure 1:
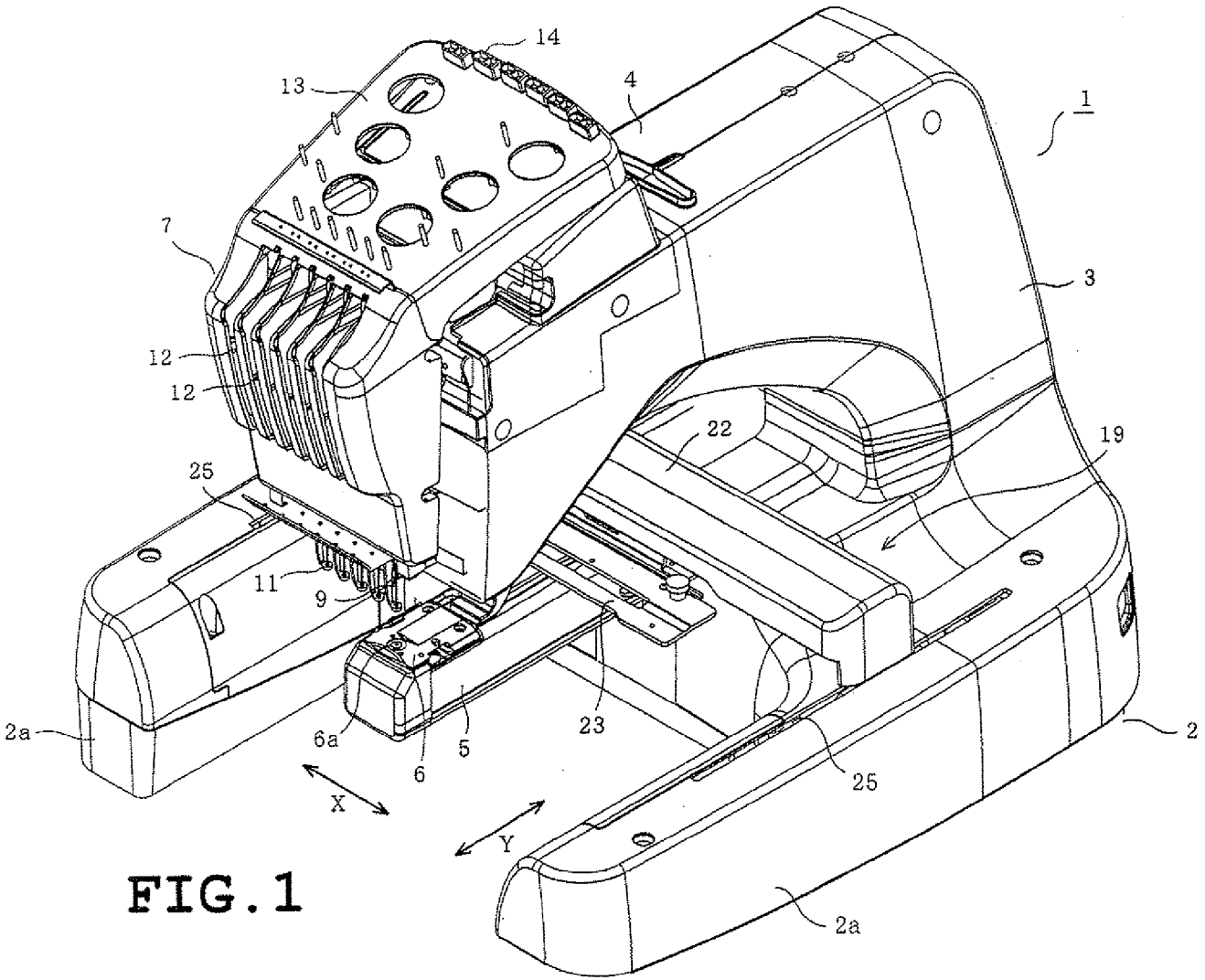
FIG. 1 is a perspective view of a sewing machine body according to a first exemplary embodiment of the present disclosure.

Referring to FIG. 1, sewing machine 1 is primarily configured by support base 2 placed on a placement base not shown, pillar 3 extending upward from the rear end of support base 2, and arm 4 etc., extending forward from the upper end of pillar 3. Support base 2 is configured in U-shape in top view with left and right feet 2*a* extending forward to embrace a forward opening between them. Support base 2 is further provided integrally with cylinder bed 5 extending forward from its rearward mid portion. On the upper portion of the extremity of cylinder bed 5, needle plate 6 is provided that has needle holes 6*a* defined on it. Though not shown, cylinder bed 5 contains components such as a loop taker shuttle, a thread cut mechanism, and a picker.

Though not shown, on the rear side upper portion of arm 4, thread supplier is provided that has six thread spools, for example, set to it. Though also not shown, a control panel is provided on the right side of arm 4. Though only shown in FIG. 6, the control panel is provided with control switches 45 to allow the user to make various instructions, selections and inputs and a liquid crystal display, simply represented as LCD in FIG. 6, that displays various messages to be presented to the user.

Figure 2:
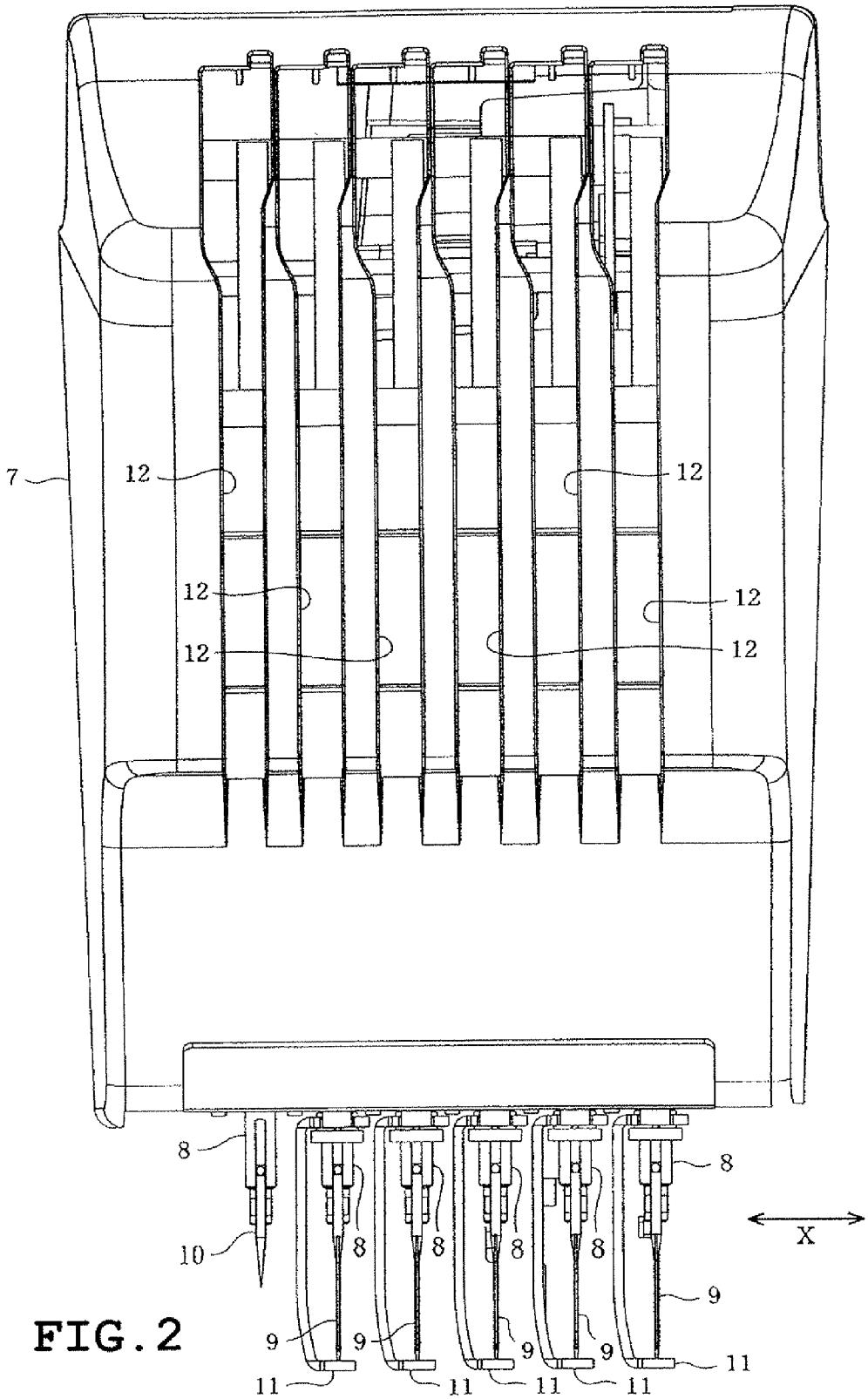
FIG. 2 is a front view of a needle bar case.

As also shown in FIG. 2, on the extremity of arm 4, needle bar case 7 is provided which is movable in the left and right direction. As can be seen in FIG. 2, needle bar case 7 is longitudinally thin, and comes in a shape of a rectangular box. Needle bar case 7 contains a plurality of needle bars 8, six, in the present exemplary embodiment, aligned in the left and right direction so as to be movable up and down. Each needle bar 8 is subject to consistent upward bias toward the uppermost position shown in FIG. 2 by a coil spring not shown.

Figure 3A:
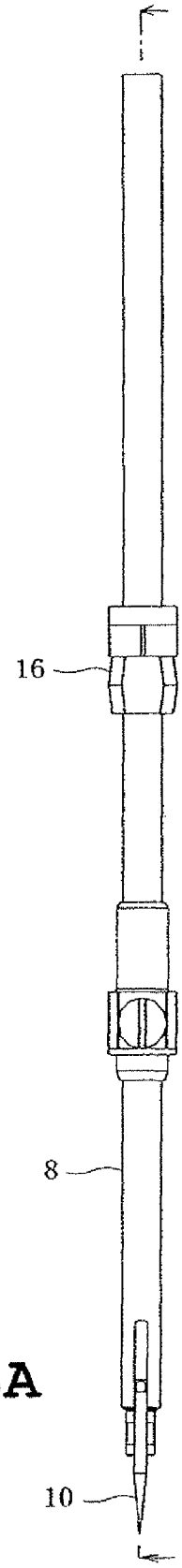
FIG. 3A is a front view of a needle bar with a punch needle attached.
Figure 3B:
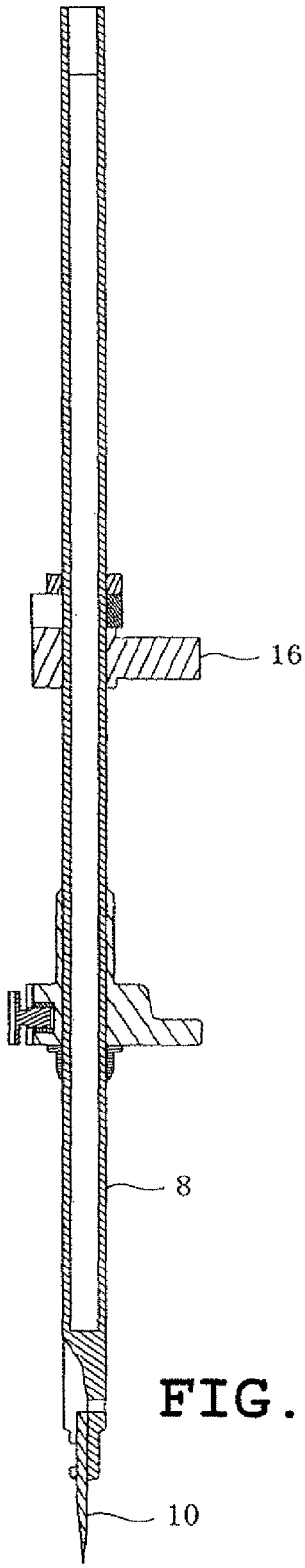
FIG. 3B is a vertical cross sectional right side view of the needle bar with punch needle attached.

The lower ends of these needle bars 8 extend downward out of needle case 7 and sewing needle 9 used for embroidery sewing is detachably/interchangeably attached to them. The six needle bars 8 are identified by needle bar numbers 1 to 6, in this case, in ascending order from right to left. As can be seen in FIGS. 3A and 3B, the leftmost specific needle bar 8 among the six needle bars 8, that is, the no. 6 needle bar 8, has punch needle 10 detachably attached to it instead of sewing needle 9. Punch needle 10 will be later described in detail.

Referring to FIG. 2, at the lower potion of needle bar 8, presser foot 11 for use in embroidery sewing is provided that is moved up and down in synchronism with needle bar 8. In the present exemplary embodiment, presser foot 11 for the no. 6 needle bar 8 is removed when punch needle 10 is attached instead of sewing needle 9. Though not shown in detail, six thread take-ups are provided above needle bar case 7 dedicated for each of the six needle bars 8. The tip of each thread-take up protrudes forward through six vertical slits 12 defined on the front face of needle bar case 7 and is driven up and down in synchronism with the up and down movement of needle bar 8. Though also not shown, behind needle bar 8, being placed in a position to be driven up and down by a later described needle-bar vertically moving mechanism, a wiper is provided.

Referring to FIG. 1, needle bar case 7 has upper cover 13 provided integrally with it that extends obliquely reward from its upper end. Though only mounting holes are shown, upper cover 13 is provided with six thread tension regulators along with six thread amount sensors 14 provided on its upper end. The needle thread for embroidery sewing is drawn from the thread spools set to the thread supplier and is sequentially engaged with a threading route including components such as thread amount sensor 14, thread tension regulators, and thread take-ups. When needle thread is finally passed through eye not shown of sewing needle 9, sewing machine 1 is ready for embroidery sewing. By supplying different colors of needle threads to each of the six or five sewing needles 9, embroidery sewing operation with multiple needle colors can be executed consecutively by automatic switching of thread colors.

Figure 6:
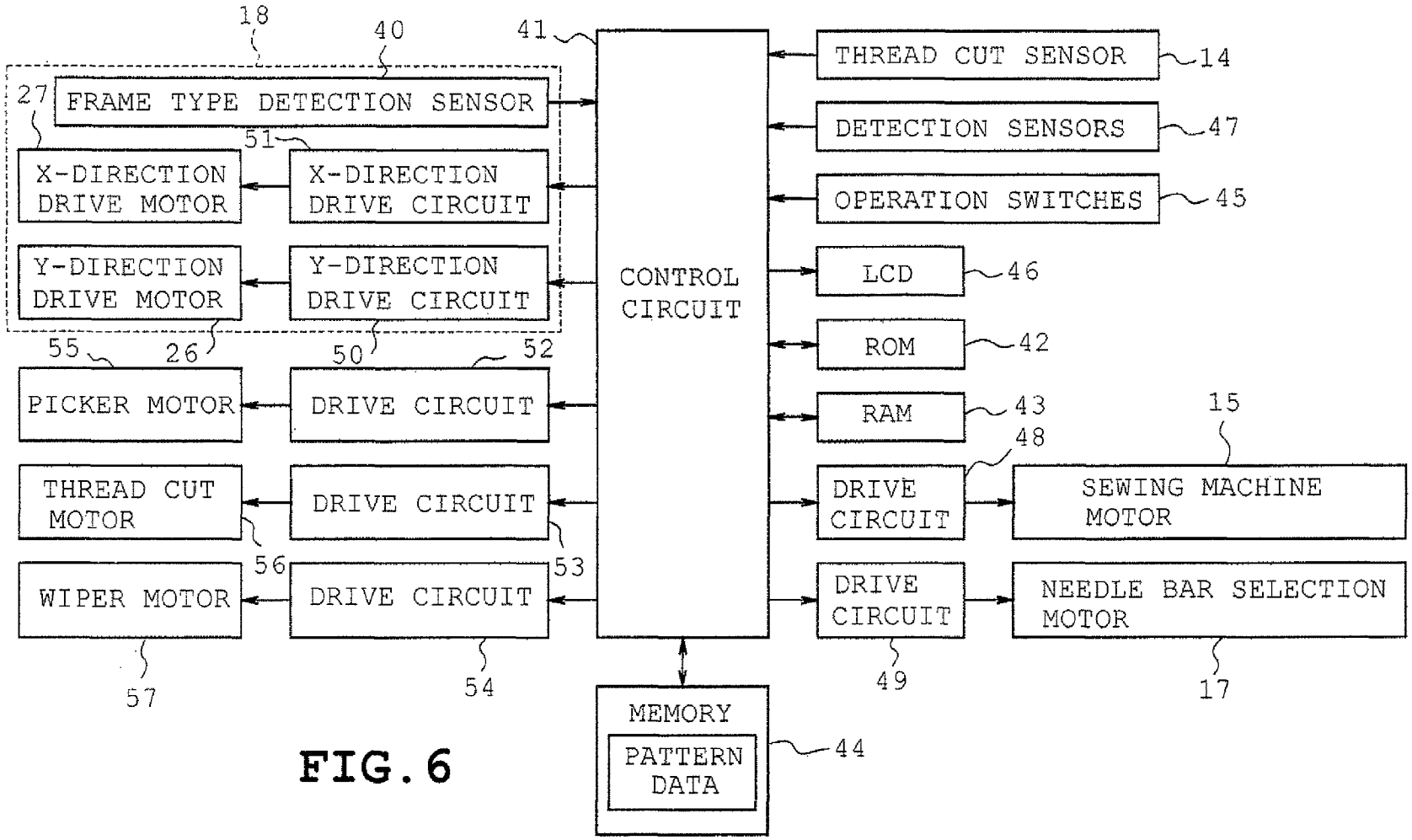
FIG. 6 is a block diagram schematically illustrating an electrical configuration of multi-needle sewing machine.

Though not shown in detail, pillar 3 is provided with sewing machine motor 15 only shown in FIG. 6. As known in the art, arm 4 is provided with components such as a main shaft driven by sewing machine motor 15, a needle-bar vertically driving mechanism that vertically moves needle bars 8 etc., by the rotation of the main shaft, and a needle-bar selector/driver mechanism that selects needle bar 8 by moving needle bar case 7 in the X-direction. The rotation of the rotary shaft also causes loop taker shuttle to be driven in synchronism with the up and down movement of needle bar 8.

Needle-bar vertically moving mechanism is provided with a vertically moving element that is selectively engaged with needle bar clamp 16 shown in FIG. 3B provided at needle bar 8. The needle-bar selector/driver mechanism is driven by needle-bar selection motor 17 only shown in FIG. 6 to move needle bar case 7 in the X-direction to select either of needle bars 8, located immediately above needle hole 6*a*, to be engaged with the vertically moving element. Needle-bar selector/driver mechanism configured as described above selects one of the needle bars 8 and the selected needle bar 8 and the thread take-up corresponding to the selected needled bar 8 is moved up and down by the needle-bar vertically moving mechanism.

Figure 4:
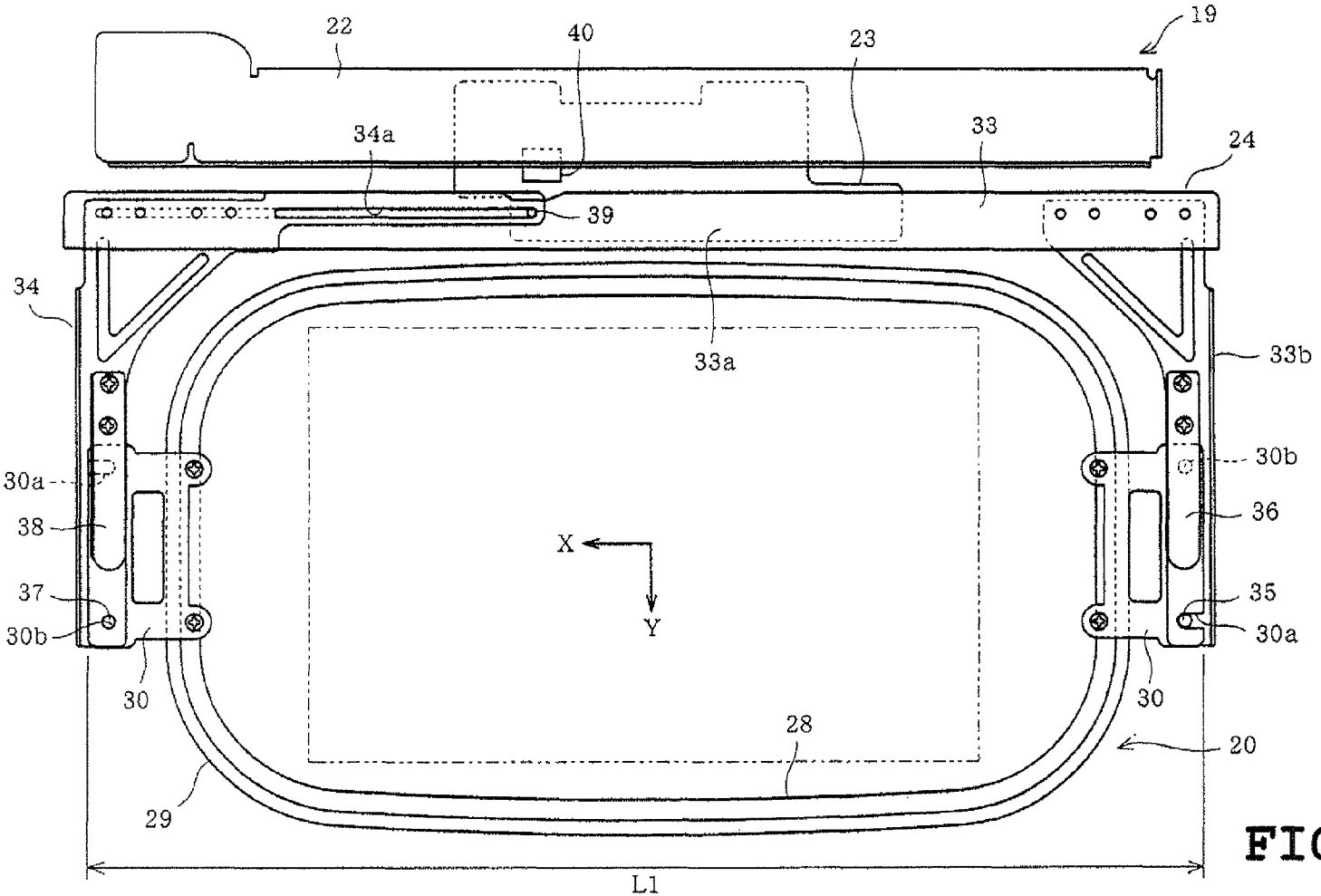
FIG. 4 is a plan view of a frame holder with an embroidery frame attached.

Then as shown in FIG. 1, in the front side of pillar 3 above support base 2, carriage 19 of transfer mechanism 18 is provided slightly above cylinder bed 5. Carriage 19 allows detachable attachment of a holder that holds a workpiece, that is, a workpiece cloth on which embroidery is formed or punch workpiece W shown in FIGS. 5A and 5B on which punch engraving is formed. In the present exemplary embodiment, holder comes in the form of embroidery frame 20, one example of which is shown in FIG. 4, that holds various types of workpiece, and punch workpiece 21 shown in FIGS. 5A and 5B that holds punch workpiece W. The holders are provided as accessories to sewing machine 1.

As shown in FIGS. 1 and 4, carriage 19 is provided with Y-direction carriage 22, X-direction carriage 23 attached to Y-direction carriage 22, and frame holder 24 only shown in FIG. 4 attached to X-direction carriage 23. Though not shown in detail, transfer mechanism 18 includes a Y-direction drive mechanism provided within Y-direction carriage 22. Y-direction drive mechanism moves Y-direction carriage 22 freely in the Y direction, that is, the front and rear direction. Transfer mechanism 18 also includes an X-direction drive mechanism provided within Y-direction carriage 22. The X-direction drive mechanism transfers X-direction carriage 23 and frame holder 24 in the X direction, that is, the left and right direction. The holder, holding the workpiece is held by frame holder 24 and is transferred in the two predetermined directions, that is, the X and the Y directions by transfer mechanism 18.

To elaborate, Y-direction carriage 22 comes in a shape of an elongate, narrow box which extends in the X direction or the left and right direction over feet 2*a*. As can be seen in FIG. 1, on the upper surface of left and right feet 2*a* of support base 2, guide groove 25 is defined that runs in the Y direction or the front and rear direction. Though not shown, the Y-direction mechanism is provided with a couple of transfer elements that vertically penetrates these guide grooves 25 to allow Y direction or front and rear movement along guide grooves 25. Both left and right ends of Y-direction carriage 22 is connected to the upper end of the couple of movement elements respectively.

The Y-direction drive mechanism is configured by components such as Y-direction drive motor 26 shown in FIG. 6 comprising a step motor, and a linear transfer mechanism including components such as a timing pulley and timing belt. The linear transfer mechanism driven by Y-direction drive motor 26 moves the movement elements to allow Y-direction carriage 22 to be moved in the Y direction or the front and rear direction.

Referring to FIGS. 1 and 4, a portion of X-direction carriage 23 protrudes forward from the lower front side of Y-direction carriage 22. X-direction carriage 23 comes in the form of a wide plate and is supported slidably in the X-direction or the left and right direction by Y-direction carriage 22. The X-direction drive mechanism provided within Y-direction carriage 22 is provided with a linear transfer mechanism including components such as X-direction drive motor 27 shown in FIG. 6 comprising a step motor, a timing pulley and timing belt. X-direction carriage 23 is moved in the X direction or the left and right direction by the above described configuration.

Next, a description will be given on frame holder 24 attached to X-direction carriage 23, and embroidery frame 20 and punch workpiece holder 21 serving as a holder being detachably attached to frame holder 24. First, a description will be given on embroidery frame 20 with reference to FIG. 4. Embroidery frame 20 comprises inner frame 28 generally formed as a rectangular frame with rounded corners, outer frame 29 fitted detachably on the outer periphery of inner frame 28, and a pair of connecting portions 30 mounted on both left and right ends of inner frame 28. Though not shown, the workpiece, in this case, the workpiece cloth is clamped between inner frame 28 and outer frame 29 to hold the workpiece cloth in tense, stretched state within inner frame 28.

The left and right pair of connecting portions 30 is provided on embroidery frame 20 so as to have 180-degrees rotational symmetry in plan view. Connecting portions 30 have engagement grooves 30*a* and engagement holes 30*b* for attachment to frame holder 24. Though not shown, different types of embroidery frame 20 are provided that come in different sizes and shapes having varying embroidery areas and are selected interchangeably depending on the size of the workpiece cloth and the embroidery. The width in the left and right direction, that is, the measurement between the outer edges of the connecting portions 30 represented as L1 in FIG. 4, is configured to vary depending upon the type of embroidery frame 20. The variance in width L1 allows the later described detector to detect the type of embroidery frame 20 and whether or not punch workpiece holder 21 has been attached instead of embroidery frame 20. FIG. 4 shows embroidery frame 20 having the greatest width L1.

Figure 5A:
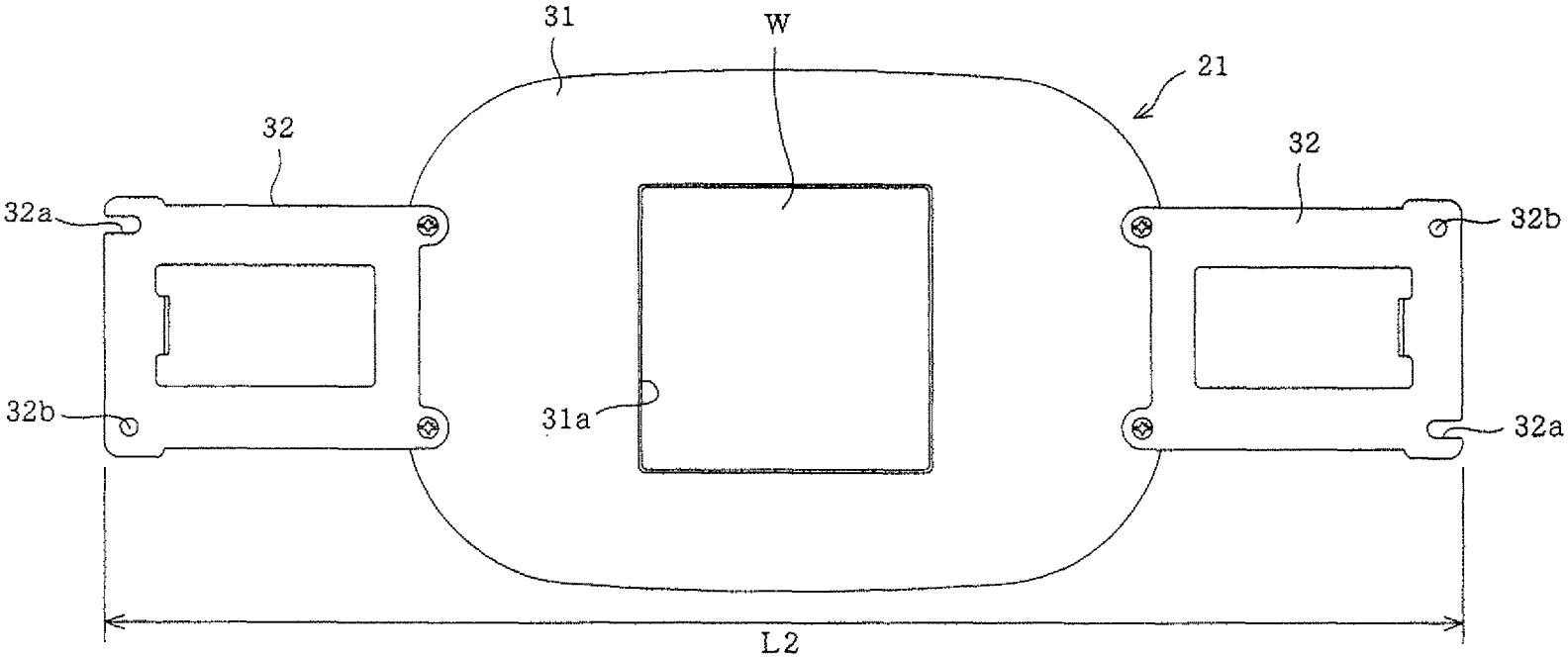
FIG. 5A is a plan view of a punch workpiece holder.
Figure 5B:
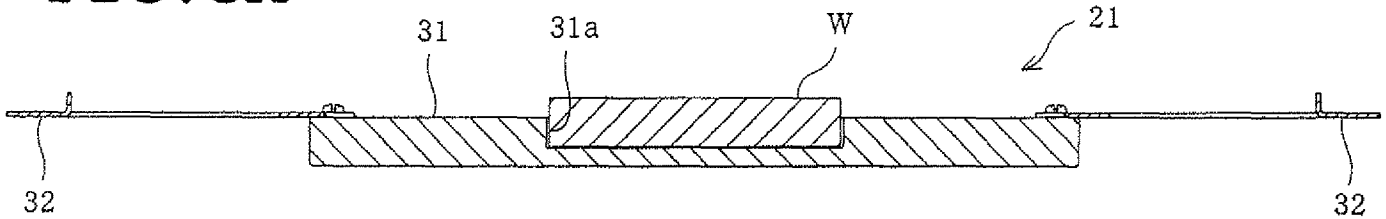
FIG. 5B is a vertical cross sectional front view of a punch workpiece holder.

Next, a description will be given on punch workpiece holder 21. As shown in FIGS. 5A and 5B, punch workpiece holder 21 is provided with holder section 31 shaped as a rectangular plate with rounded corners and a pair of connecting portions 32 mounted on left and right ends of holder section 31. On the face of holder section 31, an enclosed bottom holder recess 31*a* is defined in a rectangular shape. Holder recess 31*a* receives punch workpiece W which comes in a rectangular plate form that is preinstalled into rectangular recess 31*a*. Punch workpiece W may be made of any material that the user prefers such as an acryl resin plate, metal plate such as aluminum and brass, wooden or plywood plate, and boards made of solidified fiber. Punch workpiece W is held at a specific location of punch workpiece holder 21 with its underside received in substantially sealed contact by holder recess 31*a*.

The left and right pair of connecting portions 32 is also disposed in 180-degrees rotational symmetry in plan view. Connecting portions 32 have engagement grooves 32*a* and engagement holes 32*b* for attachment to frame holder 24. The width in the left and right direction of punch workpiece holder 21, that is, the measurement between the outer edges of the connecting portions 32 represented as L2 in FIG. 5A, is configured to vary from width L1 of any given type of embroidery frame 20. Different types of punch workpiece W may also be provided depending on the sizes and shapes etc., of punch workpiece W as was the case of embroidery frame 20.

Frame holder 24 to which the above described embroidery frame 20 and punch workpiece 21 are attached/connected is configured as described below. Referring to FIG. 4, frame holder 24 is provided with holder body 33 mounted unremovably on the upper surface of X-direction carriage 23, and movable arm 34 mounted relocatably on holder body 33. Movable arm 34 is relocated in the left and right direction by the user depending upon the type, that is, width L1 or L2 of embroidery frame 20 or punch workpiece holder 21, whichever is attached.

Holder body 33 has main section 33*a* shaped as a plate elongated in the left and right direction defined as the X direction. At the right end of main section 33*a*, right arm 33*b* is provided that is bent in a substantially right angle to extend forward. Provided on the upper surface extremity of right arm 33*b* are engagement pin 35 and leaf spring 26 for clamping connecting portions 30 and 32 provided rearward relative to engagement pin 35. Engagement pin 35 engages with engagement groove 30*a* of connecting portion 30 of embroidery frame 20 or engagement groove 32*a* of connecting portion 32 of punching holder 21.

Movable arm 34 is symmetrical in the left and right direction with right arm 33*b*. The base end or the rear end of movable arm 34 is mounted on main section 33*a* of holder body 33 so as to be placed over the left side upper surface of main section 33*a*. Provided on the upper surface extremity of movable arm 34 are engagement pin 37 and leaf spring 38 for clamping connecting portions 30 and 32 provided rearward relative to engagement pin 37. Engagement pin 37 engages with engagement hole 30*b* of connecting portion 30 of embroidery frame 20 or engagement hole 32*b* of connecting portion 32 of punching holder 21.

On the base end or the rear end of movable arm 34, guide groove 34*a* is provided that extends in the left and right direction. Guide groove 34*a* allows engagement of guide pin 39 provided on the upper surface of main section 33*a* of holder body 33. Thus, movable arm 34 is allowed to slide in the left and right direction relative to main section 33*a* of holder body 33. Though not shown, main section 33*a* of holder body 33 is provided with a lock mechanism that allows movable arm 34 to be selectively locked at different predetermined positions. The position of movable arm 34 is relocated in the left and right direction through user operation of the lock mechanism.

The above described configuration allows the user to lock movable arm 34 at a position suitable for the type, in other words, the width of embroidery frame 20 or punching holder 21 to be attached and proceed to attachment of embroidery frame 20 or punching holder 21 to frame holder 24. As exemplified in FIG. 4, in attaching embroidery frame 20 to frame holder 24, first, connecting portions 30 at the left and right ends of embroidery frame 20 are each inserted in the rearward direction from the front side of leaf spring 38 of movable arm and leaf spring 36 of right arm 33*b*, respectively. Then, engagement pin 37 of movable arm 34 is engaged with engagement hole 30*b* of connecting portion 30 and engagement pin 35 of right arm 33*b* is engaged with engagement groove 30*a* of connecting portion 30. Thus, embroidery frame 20 is held by frame holder 24 and transferred in the X and Y directions by transfer mechanism 18. Punch workpiece holder 21 is attached to frame holder 24 in the same manner.

As shown in FIGS. 4 and 6, X-direction carriage 23 is provided with frame-type sensor 40 for detecting the type of embroidery frame 20 or punch workpiece holder 21 attached through detection of the position of movable arm 34. Though not shown, frame-type sensor 40 comprises a rotary potentiometer, for example, and is provided with a detection tip that is placed in contact with detection subject comprising a sloped surface, for example, provided on movable arm 34. The resistance, that is, the output voltage produced by potentiometer varies depending on the variance of rotational position, in other words, the angle of detection tip caused by the relocation of movable arm 34 in the left and right direction. As shown in FIG. 6, the output signal of frame-type detection sensor 40 is inputted to a later described control circuit 41 whereafter the type of embroidery frame 20 or punch workpiece holder 21 is determined by control circuit 41.

In the present exemplary embodiment, sewing machine 1 is capable of executing a normal sewing operation on the workpiece cloth using six colors of embroidery thread as well as executing punch engraving. Punch engraving is executed by impinging punch needle 10 dot by dot on the surface of workpiece W while transferring punch workpiece holder 21 in the X and Y directions by transfer mechanism 18 to engrave the desired objects such as photograph, illustration and characters. In executing a punch engraving operation, sewing needle 9 provided on the leftmost, that is, the no. 6 needle bar 8 of the six needle bars 8 is replaced by punch needle 10 for punch engraving as shown in FIG. 2.

As shown in FIGS. 3A and 3B, punch needle 10 has a mount section at its base end or the upper end for attachment to needle bar 8 and a pointed tip at its lower end suitable for punch engraving. Punch needle 10 impacts the surface of workpiece W held by punch workpiece holder 21 at the lowermost point of reciprocation of needle bar 8. This means that because punch needle 10 does not penetrate the workpiece cloth, it is designed at shorter length as compared to sewing needle 9.

Though not shown, punch needle 10 comes in different length, thickness, and tip shapes and the user is allowed to select one suitable punch needle 10 and attach the selected punch needle 10 on the no. 6 needle bar 8. Further, as shown in FIG. 2, presser foot 11 is removed from needle bar 8 having punch needle 10 attached to it. As one may readily assume, in case punch needle 10 is attached to the no. 6 needle bar 8, embroidery sewing operation is executed with the remaining five needle bars 8 no. 1 to 5 using embroidery threads of five colors or less.

FIG. 6 schematically indicates the electrical configuration of multi-needle embroidery sewing machine according to the present exemplary embodiment with a primary focus on control circuit 41. Control circuit 41 is primarily configured by a computer, in other words, a CPU establishing connection with ROM 42, RAM 43, and external memory 44. ROM 42 stores items such as embroidery sewing control program, punch engraving control program, punch engraving pattern data generating program, and various types of control data. External memory 44 stores items such as various types of embroidery pattern data and punch engraving pattern data.

Control circuit 41 receives input of operation signals produced from various operation switches 45 of operation panel and is also responsible for controlling the display of LCD 46. The user, while viewing LCD 46, operates various operation switches 45 to select the sewing mode such as the embroidery sewing mode, punch engraving mode, punch engraving pattern generation mode and to select the desired embroidery pattern and the punch engraving pattern.

Control circuit 41 also receives input of detection signals such as detection signals from thread cut sensor 14, frame-type detection sensor 40, and other detection sensors 47. Control circuit 41 controls the drive of sewing machine motor 15 through drive circuit 48 and needle-bar selection motor 17 through drive circuit 49.

Control circuit 41 further controls the drive of Y-direction drive motor 26 for transfer mechanism 18 through drive circuit 50, and X-direction drive motor 27 through drive circuit 51 to drive frame holder 24 and consequently embroidery frame 20 and punch workpiece holder 21. Further, control circuit 41 executes thread cut operation by controlling picker motor 55 serving as a drive source for a picker not shown, thread cut motor 56 serving as a drive source for a thread cut mechanism not shown, and wiper motor 57 serving as drive force for a wiper not shown through drive circuits 52, 53, and 54, respectively.

Next, a brief description will be given on the above mentioned picker and wiper. Thread cut mechanism well known in the art will not be described. Picker operates so as to contact the loop taker shuttle at the start of the embroidery sewing operation and when executing a needle cut operation and temporary secures a certain amount of needle thread. Thus, needle thread end can be prevented from remaining on the upper surface of workpiece cloth and from falling out of the eye of the sewing needle when starting the sewing operation. Wiper pulls up the thread end of the needle thread cut by the thread cut mechanism to the upper surface of workpiece cloth. The above movement of the wiper is called the thread wiping operation.

Control circuit 41 executes the embroidery sewing control program, in other words, automatically executes the embroidery sewing operation on the workpiece cloth held by embroidery frame 20 when in the embroidery sewing mode. When executing the embroidery sewing operation, the user is to select pattern data from a collection of pattern data for embroidery sewing stored in external memory 44. Embroidery sewing operation is executed by controlling components such as sewing machine motor 15, needle-bar selection motor 17, Y-direction drive motor 26 and X-direction drive motor 27 of transfer mechanism 18 based on the selected pattern data.

As well known, pattern data for embroidery sewing contains stitch-by-stitch needle drop point, that is, stitch-by-stitch data or transfer data indicating the amount of X direction or Y direction movement of embroidery frame 20. Further, pattern data contains data such as color change data that instructs switching of embroidery thread color, that is, switching of needle bar 8 to be driven, thread cut data that instructs the thread cut operation, and sew end data. Further, the stitch-by-stitch data contains under stitch data for feeding the workpiece without cutting the thread and for strengthening the embroidery. The under stitches are indeed formed as stitches but do not show in the embroidery because they are ultimately hidden other embroidery threads.

In the present exemplary embodiment, control circuit 41 automatically executes punch engraving operation on the surface of punch engraving workpiece W held by punch engraving holder 21 with punch needle 10 through software configuration, that is, the execution of punch engraving control program. In the punch engraving operation or the punch engraving mode, controller 41 controls sewing machine motor 15, needle-bar selection motor 17, and Y direction motor 26 and X direction motor 27 of transfer mechanism 18.

Punch engraving operation is executed by selecting the no. 6 needle bar 8 and repeatedly moving needle bar 8, that is, punch needle 10 up and down while moving punch workpiece W to the next punching point when needle bar 8 is elevated. Punch engraving pattern data is primarily configured by a collection of stitch-by-stitch position of punching point of punch needle 10, in other words, stitch-by-stitch movement amount in the X and Y directions of punch workpiece holder 21, that is, punch workpiece W.

As later described in explaining the flowchart, control circuit 41 executes punch engraving operation provided that attachment of punch workpiece holder 21 to frame holder 24 has been detected. This means that, the sewing operation, stated differently, the activation of sewing machine motor 15 is not permitted even if execution of punch engraving is instructed by the user when attachment of punch workpiece holder 21 has not been detected.

In the present exemplary embodiment, as later described in explaining the flowchart, control circuit 41 generates punch engraving pattern data from pattern data of an embroidery pattern by executing punch engraving pattern data generating program. Generation of punch engraving pattern data is executed by extracting only the transfer data for driving transfer mechanism 18 from the pattern data of the embroidery pattern to allow execution of punch engraving for forming a patter identical to the embroidery pattern. When generating the punch engraving pattern data, in other words, when extracting transfer data, color change data and thread cut data is eliminated from the pattern data as well as the under stitch data contained in the stitch-by-stitch data.

Further, in the present exemplary embodiment, control circuit 41, when detecting the attachment of punch workpiece holder 21 by frame-type detection sensor 40, meaning that the punch engraving operation is executed, a control is executed to prohibit operations specific or unique to embroidery sewing. The control executed to prohibit operation specific or unique to embroidery sewing includes thread cut operation by the thread cut mechanism, thread wiping operation by the wiper, and thread cut detection by thread cut sensor 14. The drive speed of needle bar 8 during the punch engraving operation, that is, the rotational speed of the main shaft is preferable if set at a relatively low speed of 800 rpm compared to the maximum speed of 1000 rpm during the embroidery sewing operation. Driving needle bar 8 at a speed exceeding the maximum speed during the punch engraving operation is also considered as an operation specific to embroidery sewing.

Figure 7:
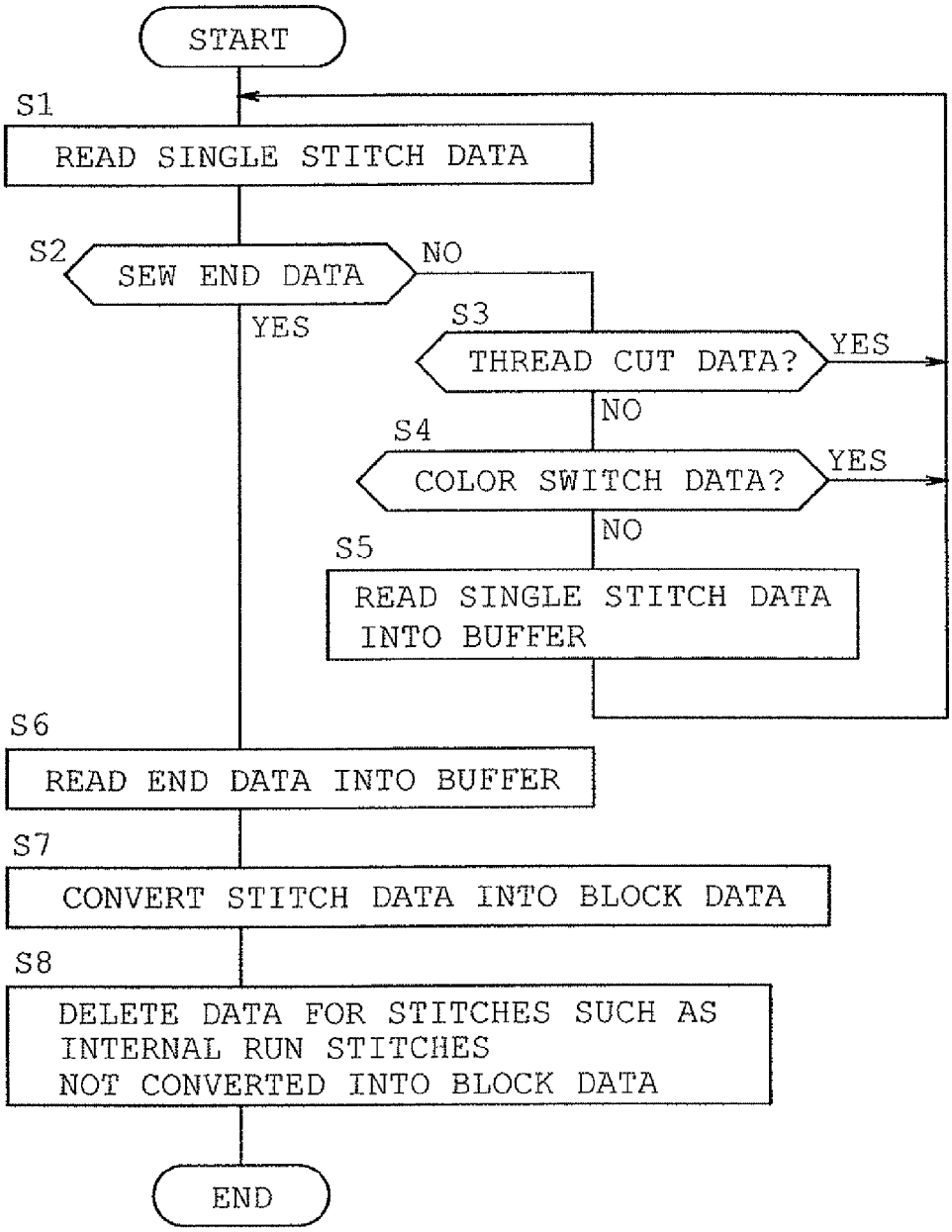
FIG. 7 is a flowchart indicating a process flow of punch engraving pattern data generation.

Next, the operation of the above described configuration is described with reference to FIGS. 7 and 8. First, as described above, control circuit 41 executes the punch engraving pattern data generating mode to generate the punch engraving pattern data according to user instructions by extracting only the transfer data for driving transfer mechanism 18 from the pattern data for embroidery sewing stored in external memory 44 or ROM 42. The flowchart indicated in FIG. 7 provides a summary of the process flow of the punch engraving pattern data generating process executed by control circuit 41.

Generation of the punch engraving pattern data is instructed through operation of various operation switches 45. The desired embroidery pattern is selected from the pattern data stored in ROM 42 or external memory 44. As the first step of the punch engraving pattern data generating process, the stitch-by-stitch data contained in the pattern data is read sequentially from the first data entry at step S1. Then, at steps S2 to 4, a determination is made as to the type of data read at step S1. More specifically, a determination is made as to whether or not the data read at step S2 is sew end data.

If determined that the read data is not sew end data (step S2: No), a determination is further made as to whether or not the read data is thread cut data at step S3. If determined that the read data is thread cut data (step S3: Yes), the process flow returns to step S1 and the next data is read. If determined that the read data is not thread cut data (step S3: No), a determination is further made at step S4 as to whether or not the read data is a color change data If the read data is color change data (step S4: Yes), the process flow returns to step S1 and the next data is read.

If determined that the read data is not color change data (step S4: No), the read data can be determined to be stitch-by-stitch data, that is, the transfer data, and thus, the stitch-by-stitch data is read into the buffer. Then, the process flow returns to step S1 to read the next data. By repeating the above described steps, only the transfer data indicating the stitch-by-stitch needle drop point, in other words, the X and Y direction movement amount of carriage 19 is extracted and read into the buffer. On reading the sew end data coming at the data end (step S2: Yes), end data is read into the buffer at step S6. Then, the stitch data is transformed into block data based upon which punch engraving is sequentially executed block by block (step S7). Further, under stitch data for stitches such as inner run stitches is deleted (step S8) to complete the punch engraving pattern data generating process.

Thus, punch engraving pattern data configured by a collection of data indicating the stitch-by-stitch punching position of punching needle 10, that is, the X and Y direction movement amount of carriage 19 and consequently punch workpiece holder 21 for punch engraving the embroidery pattern on the surface of the punch workpiece W is generated. In doing so, the pattern data of the embroidery pattern can be reused for the punch engraving pattern data and thus, simplifying the punch engraving pattern data generating process. As one may readily assume, the punch engraving pattern data may be pre-stored in external memory 44 and ROM 42 or may be generated and provided by an external source such as separate generator such as a personal computer.

As described above, the multi-needle embroidery sewing machine according to the present exemplary embodiment has sewing needle 9 for executing a sewing operation mounted on five needle bars 8 except for one specific needle bar 8, for instance, needle bar no. 6. Alternatively, all of needle bars 8 may have sewing needle 9 mounted on them. Embroidery sewing operation can be executed with embroidery frame 20 holding the workpiece cloth attached to frame holder 24. Embroidery sewing operation is executed by controller 41 which selectively drives needle bar 8 having sewing needle 9 attached to it through control of needle bar selection motor 17 while transferring embroidery frame 20 in the X and Y directions through control of transfer mechanism 18 based on embroidery data.

On the other hand, punch engraving operation can be executed by the user's attachment of punch needle 10 on a specific needle bar 8, that is, the no. 6 needle bar 8 and attachment of punch workpiece holder 21 holding punch workpiece W to frame holder 24. In this case, controller 41 controls transfer mechanism 18 to move punch workpiece holder 21 and consequently punch workpiece W in the X and Y directions based on punch engraving pattern data. At the same time, needle bar 8 identified by needle bar no. 6 having punch needle 10 attached to it is selectively driven by needle-bar selection motor 17 to execute the punch engraving operation. Thus, punch engraving corresponding to the punch engraving pattern data is formed by punch needle 10 being thrust on the surface of punch workpiece W.

If the user accidentally executes the embroidery sewing operation by sewing needle 9 with punch workpiece holder 21 attached to frame holder 24, it may cause sewing needle 9 to collide with punch workpiece W and/or punch workpiece holder 21, which, as one may readily imagine, may damage sewing needle 9, punch workpiece holder 21, and frame holder 24. Likewise, when punch engraving operation is executed by punch needle 10 with embroidery frame 20 holding workpiece cloth attached to frame holder 24, it may cause workpiece to be damaged by punch needle 10.

Figure 8:
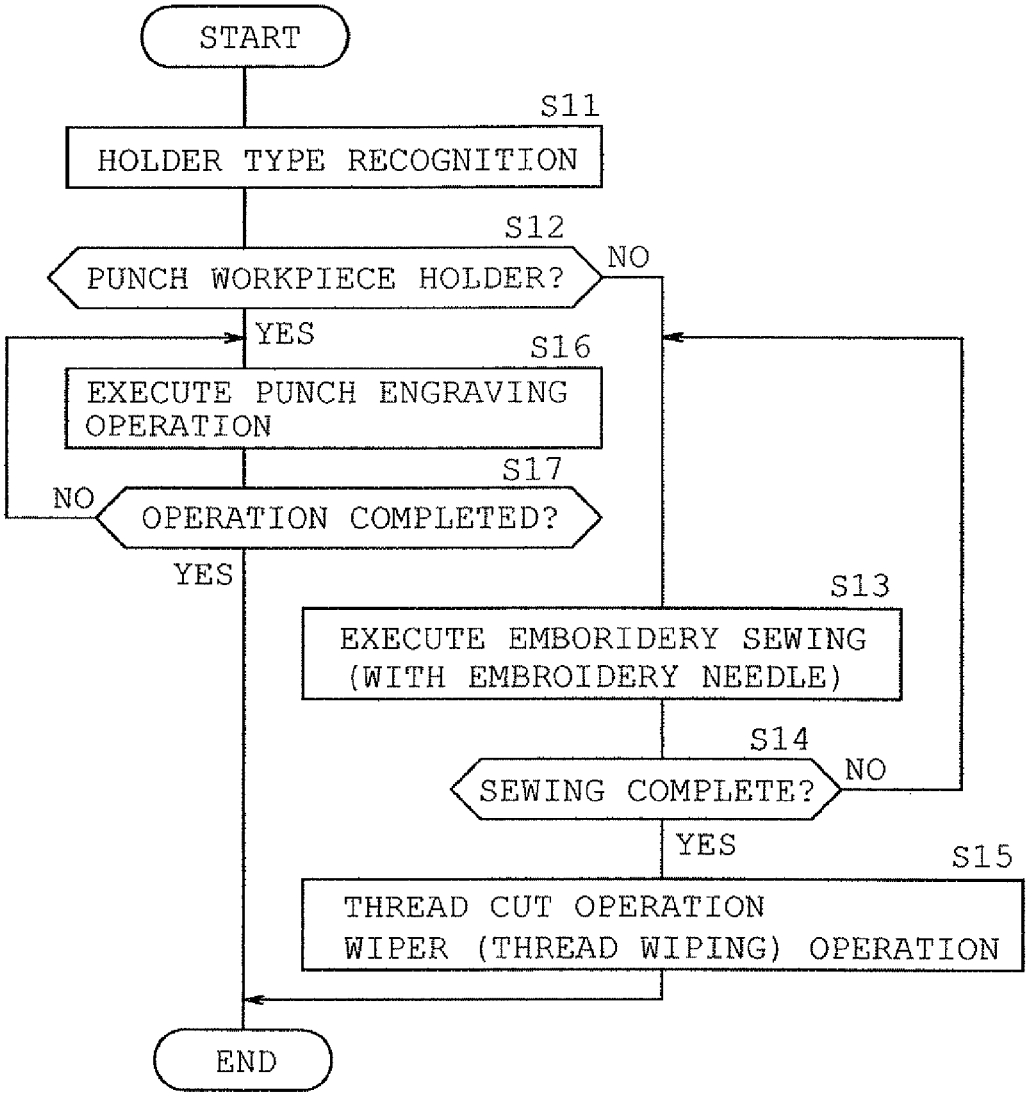
FIG. 8 is a flowchart indicating a process flow of a needle bar control executed by a controller.

When, controller 41 starts the machine operation, that is, when sewing machine motor 15 is activated, control is executed for frame-type detection performed at frame-type detection sensor 40 as shown in FIG. 8. As the first step of starting the machine operation, the recognition of the type of the holder, that is, the type of embroidery frame 20 and punch workpiece holder 21 is executed based on the output signal from frame-type detection sensor 40 at step S11. The following step S12 determines whether or not punch workpiece holder 21 is attached and the subsequent control flow varies depending upon the result.

If it has been determined that punch workpiece holder 21 is not attached, meaning that embroidery frame 20 is attached (S12: No), step S13 and beyond executes the embroidery sewing operation with sewing needle 9 until the sewing operation is completed. When the sewing operation is completed (S14: Yes), thread cut operation and thread wipe operation by the wiper is executed at step S15 to complete the process. The recognition process at step S11 allows the frame type of embroidery frame 20 to be detected. Thus, step S11 is capable of executing controls that correspond to the type of embroidery frame 20 attached such as reporting an error when the size of the selected pattern data is greater than the sew area of embroidery frame 20 indicated by imaginary line in FIG. 4.

In contrast, when it has been determined that punch workpiece holder 21 is attached to frame holder 24 (S12: Yes) based on the output signal from frame-type detector 40, punch engraving operation is executed by punch needle 10 at step S16. When the end data has been read and determination has been made that the sewing operation has been completed (S17: Yes), the operation is terminated accordingly. Further, though not shown, error is reported against user's attempt to execute embroidery sewing operation with punch workpiece holder 21 attached to frame holder 24 and against user's attempt to execute punch engraving with embroidery frame 20 attached to embroidery frame 24.

The above described control of control circuit 41 eliminates the risk of needle bar 8 of numbers 1 to 5 having sewing needle 9 attached to them from being driven up and down when punch workpiece holder 21 is attached to frame holder 24 as well as preventing the risk of punch engraving operation from being executed based on embroidery sewing pattern data. In contrast, when embroidery frame 20 is attached to frame holder 24, needle bar 8 having punch needle 10 attached to it can be prevented from being driven up and down as well as preventing execution of embroidery sewing operation based on punch engraving pattern data. Further, as described earlier, operations unique to embroidery sewing is prohibited when the attachment of punch workpiece holder 21 is detected by frame-type detection sensor 40.

According to the first exemplary embodiment, punch needle 10 can be attached to a specific needle bar 8 and punch workpiece holder 21 that holds punch workpiece W can be transferred by transfer mechanism 18 based on punch engraving pattern data. Thus, a punch engraving operation can be executed on the surface of punch workpiece W in addition to an execution of a normal embroidery sewing operation on a workpiece cloth to allow the multi-needle sewing machine to be used as a punch engraving device as well. Control circuit 41 executes a control to perform a punch engraving operation when the attachment of punch workpiece holder 21 is detected by frame-type sensor 40. Thus, the possibility of inappropriate operation not corresponding to the types of the attached holders 20 and 21 can be effectively eliminated.

Further according to the first exemplary embodiment, control circuit 41 is provided with a feature to generate punch engraving pattern data by extracting only the transfer data for driving transfer mechanism 18 from embroidery pattern data. Thus, if the user intends to form a punch engraving that has the same appearance as an embroidery pattern, the embroidery sewing pattern data can be partially reused in the punch engraving pattern data to simplify the process of the punch engraving data generation. Further, when the attachment of punch workpiece holder 21 is detected by frame-type detection sensor 40, control circuit 41 executes a control to prohibit execution of operations unique to embroidery sewing. Thus, unnecessary or inappropriate operations can be prevented when executing a punch engraving operation with the attachment of punch workpiece holder 21, thereby allowing execution of a smooth and efficient punch engraving operation.

Figure 9:
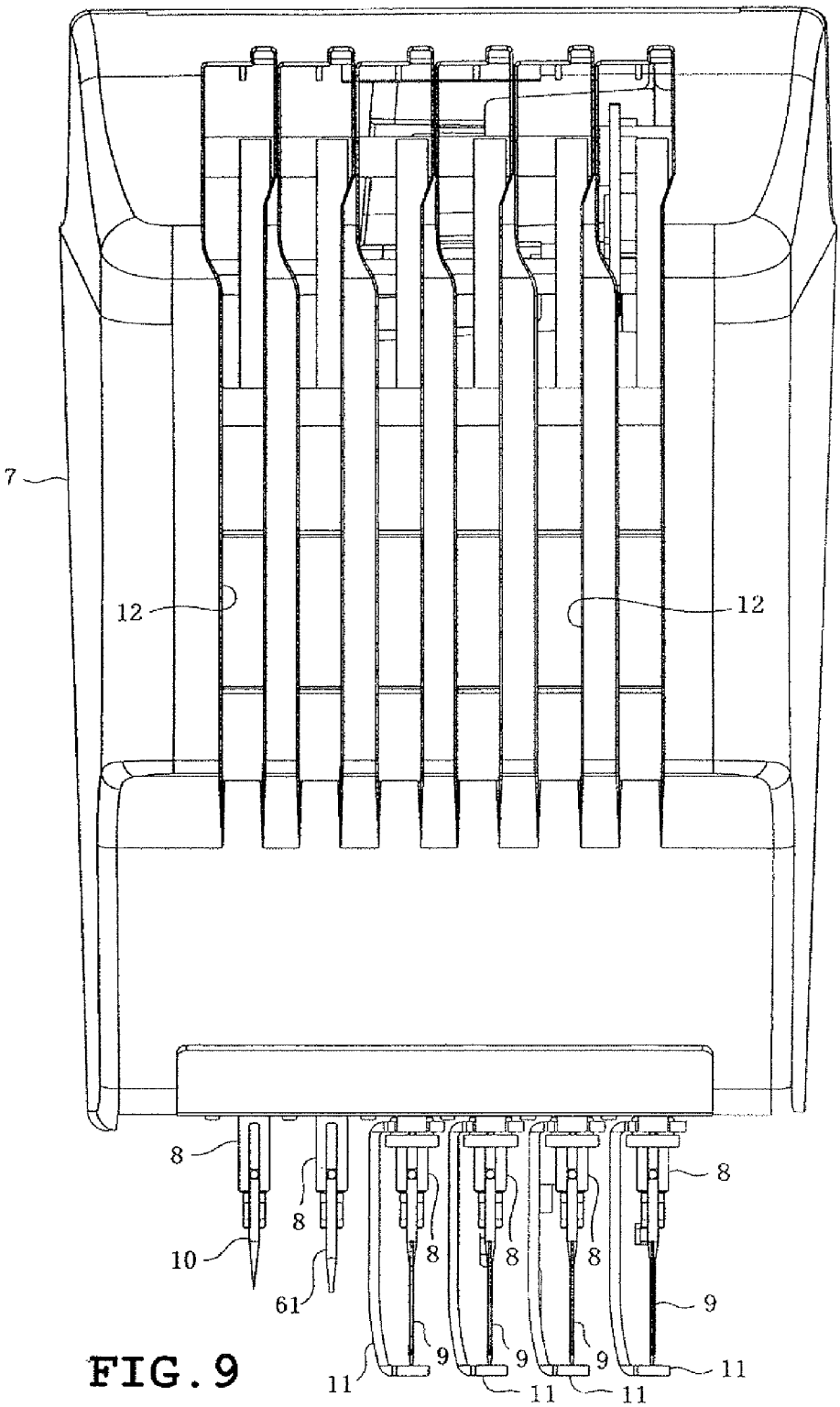
FIG. 9 corresponds to FIG. 2 and illustrates a second exemplary embodiment of the present disclosure.
Figure 10:
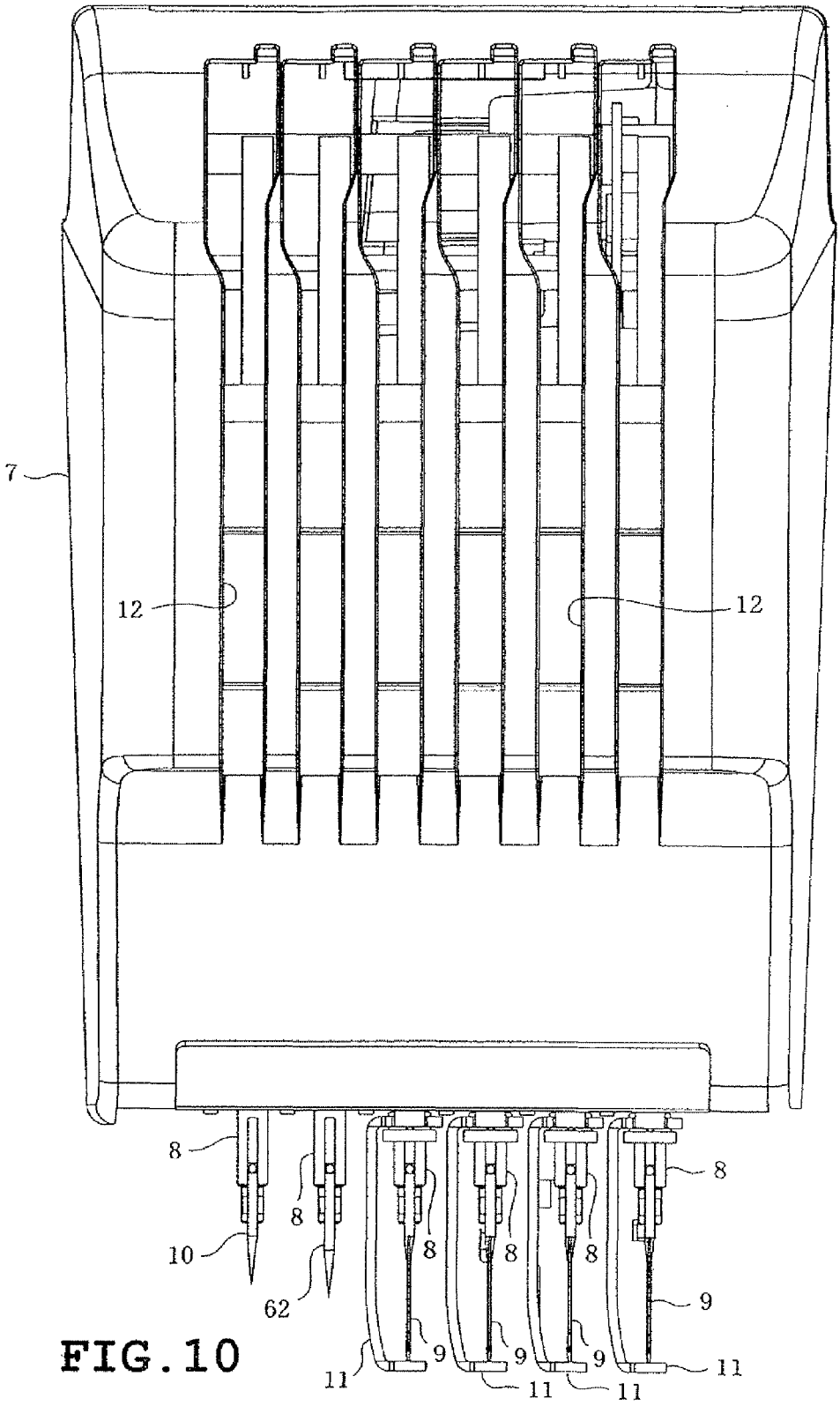
FIG. 10 corresponds to FIG. 2 and illustrates a third exemplary embodiment of the present disclosure.
Figure 11:
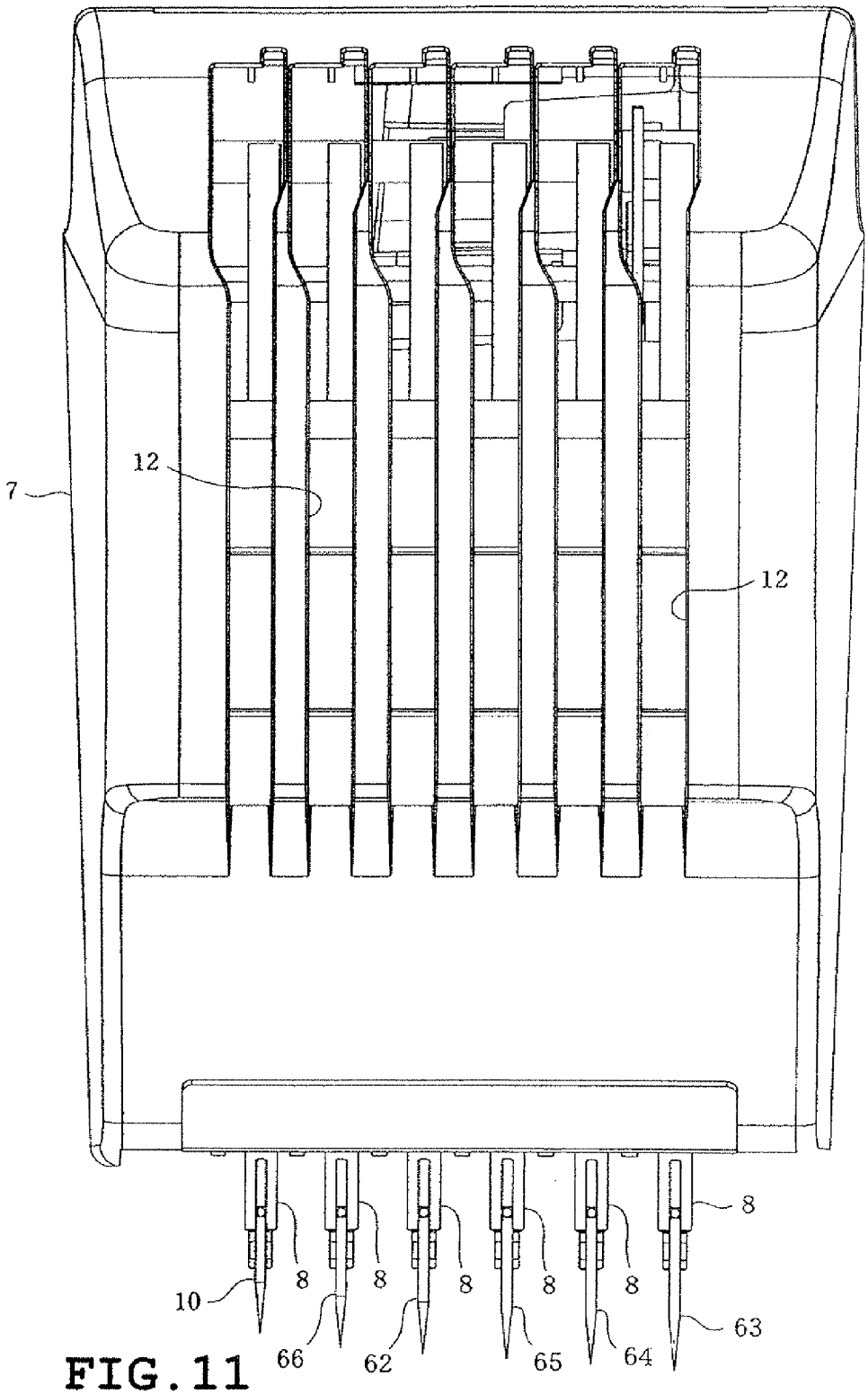
FIG. 11 corresponds to FIG. 2 and illustrates a fourth exemplary embodiment of the present disclosure.

FIGS. 9, 10, and 11 each illustrate the configuration of needle bar case 7 according to a second, third, and fourth exemplary embodiment of the present disclosure. In the second, third, and fourth exemplary embodiments, multiple types of punch needles differing in length, thickness, or tip shape are provided as accessories. These multiple types of punch needles are designed to be attached to more than one specific needle bar 8. A description will be given hereinafter on the second, third and fourth exemplary embodiments on aspects that differ from the first exemplary embodiment.

In the second exemplary embodiment shown in FIG. 9, punch needle 10 is attached to the leftmost needle bar 8 identified as the specific needle bar number 6, among the multiple, in this case, six needle bars 8 provided in needle bar case 7. Further, punch needle 61, which differs from punch needle 10, is attached to the adjacent needle bar 8 identified as needle no. 5. Sewing needle 9 and presser foot 11 are attached to the rest of the remaining four needle bars 8. Punch needle 61 has a slightly flattened tip as compared to punch needle 10. Thus, punch needle 61 leaves a relatively flat and larger engraving per dot or per impact as compared to punch needle 10. Hence, execution of punch engraving using the two punch needles 10 and 61 as appropriate produces engravings of various patterns.

Next, in the third exemplary embodiment shown in FIG. 10, punch needle 10 is attached to the leftmost needle bar 8 identified as needle bar number 6, among the multiple, in this case, six needle bars 8 provided in needle bar case 7. Further, punch needle 62, which differs from punch needle 10, is attached to the adjacent needle bar 8 identified as needle no. 5. Punch needle 62 has greater length as compared to punch needle 10. Punch needle 62 leaves a relatively deeper engraving per dot or per impact as compared to punch needle 10. Hence, execution of punch engraving using the two punch needles 10 and 62 to 66 as appropriate produces engravings of various patterns.

Next, in the fourth exemplary embodiment shown in FIG. 11, all of the multiple, in this case, six needle bars 8 provided in needle bar case 7 has punch needles 10 and 62 to 66 attached that are of different type, which may be a difference in length, for instance. Punch needles 10 and 62 to 66 are attached in the ascending order of their lengths from the left side. Hence, execution of punch engraving using the six punch needles 10 and 62 as appropriate produces engravings of even more diverse patterns. As one may readily understand, in the fourth exemplary embodiment, the user is required to replace the punch needles with sewing needle 9 when switching from punch engraving operation to embroidery sewing operation and vice versa.

The configuration of the multi-needle sewing machine is not limited to those described in the above exemplary embodiments, but may be modified or expanded as follows.

For instance, in each of the above described exemplary embodiments, frame-type detection sensor 40 provided for detecting the position of movable arm 34 provided at frame holder 24 is configured as a rotary potentiometer. However, various other sensors such as an optical sensor, magnetic sensor, and micro switches may be employed instead. The sensing performed by the sensor is not limited to indirect sensing but may be configured to directly sense the type of the holder, that is, embroidery frame 20 or punch workpiece holder 21. Further, the requirements of the present disclosure may be sufficed if a judgment can be made at least as to whether the attached holder is embroidery frame 20 or punch workpiece holder 21.

Yet, further, in the above described exemplary embodiments, punch workpiece holder 21 has been configured by holding section 31 having a holder recess 31*a* and connecting portions 32 provided at both ends of holding section 31. Instead of providing a stationary holder recess 31*a* predetermined in its size and shape, a holder mechanism which is variable in its size and shape may be provided to accommodate various types of punch workpiece W. Still further, the number of needle bars 8 provided in needle case 7 may be nine or twelve, for instance, and the overall configuration of sewing machine body 1 and its components such as transfer mechanism 18 and carriage 19 may be modified as required.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A multi-needle sewing machine, comprising:

a plurality of needle bars configured to allow detachable attachment of a sewing needle, a specific needle bar among the plurality of needle bars being configured to allow detachable attachment of a punch needle that punch engraves a surface of a punch workpiece in dot-by-dot strokes;

a needle-bar selector/driver mechanism that selects one needle bar from the plurality of needle bars and that drives the selected needle bar;

a holder that is configured to hold a workpiece and that is selected from the group of an embroidery frame that is configured to hold a workpiece cloth and a punch workpiece holder that is configured to hold the punch workpiece;

a transfer mechanism that allows detachable attachment of either of the embroidery frame and the punch workpiece holder, and that drives the holder in two predetermined directions;

a detector that detects the attachment of the punch workpiece holder on the transfer mechanism; and a controller that is configured to execute an embroidery sewing operation on the workpiece cloth with the sewing needle by controlling the needle-bar selector/driver mechanism and the transfer mechanism based on pattern data, and that, when the attachment of the punch workpiece holder is detected by the detector, is configured to execute a punch engraving operation on the punch workpiece with the punch needle by selecting the specific needle bar and by controlling the needle-bar selector/driver mechanism and the transfer mechanism based on punch engraving pattern data which is pre-stored or given by external components.

2. The multi-needle sewing machine of claim 1, wherein the punch needle is provided in a plurality of types, each type having different length or thickness or tip shape.

3. The multi-needle sewing machine of claim 1, wherein the punch workpiece holder includes a holding section that is configured to receive an underside of the punch workpiece to hold the punch workpiece in a specific stationary position, and a connection portion that is provided on an outer side of the holding section and that is detachably attached to a carriage of the transfer mechanism.

4. The multi-needle sewing machine of claim 2, wherein the punch workpiece holder includes a holding section that is configured to receive an underside of the punch workpiece to hold the punch workpiece in a specific stationary position, and a connection portion that is provided on an outer side of the holding section and that is detachably attached to a carriage of the transfer mechanism.

5. The multi-needle sewing machine of claim 1, wherein the controller is configured to generate the punch engraving data by extracting only transfer data for driving the transfer mechanism from the pattern data.

6. The multi-needle sewing machine of claim 2, wherein the controller is configured to generate the punch engraving data by extracting only transfer data for driving the transfer mechanism from the pattern data.

7. The multi-needle sewing machine of claim 3, wherein the controller is configured to generate the punch engraving data by extracting only transfer data for driving the transfer mechanism from the pattern data.

8. The multi-needle sewing machine of claim 4, wherein the controller is configured to generate the punch engraving data by extracting only transfer data for driving the transfer mechanism from the pattern data.

9. The multi-needle sewing machine of claim 1, wherein the controller prohibits operations unique to embroidery sewing when the attachment of the punch workpiece holder is detected by the detector.

10. The multi-needle sewing machine of claim 2, wherein the controller prohibits operations unique to embroidery sewing when the attachment of the punch workpiece holder is detected by the detector.

11. The multi-needle sewing machine of claim 3, wherein the controller prohibits operations unique to embroidery sewing when the attachment of the punch workpiece holder is detected by the detector.

12. The multi-needle sewing machine of claim 4, wherein the controller prohibits operations unique to embroidery sewing when the attachment of the punch workpiece holder is detected by the detector.

13. The multi-needle sewing machine of claim 5, wherein the controller prohibits operations unique to embroidery sewing when the attachment of the punch workpiece holder is detected by the detector.

14. The multi-needle sewing machine of claim 6, wherein the controller prohibits operations unique to embroidery sewing when the attachment of the punch workpiece holder is detected by the detector.

15. The multi-needle sewing machine of claim 7, wherein the controller prohibits operations unique to embroidery sewing when the attachment of the punch workpiece holder is detected by the detector.

16. The multi-needle sewing machine of claim 8, wherein the controller prohibits operations unique to embroidery sewing when the attachment of the punch workpiece holder is detected by the detector.

* * * * *